US007445517B2

(12) United States Patent
Hansen et al.

(10) Patent No.: US 7,445,517 B2
(45) Date of Patent: Nov. 4, 2008

(54) HIGH VOLTAGE CABLE ASSEMBLY WITH ARC PROTECTION

(75) Inventors: Wayne Rollins Hansen, Centerville, UT (US); Paul Gene Christean, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 290 days.

(21) Appl. No.: 10/826,774

(22) Filed: Apr. 16, 2004

(65) Prior Publication Data

US 2005/0233627 A1 Oct. 20, 2005

(51) Int. Cl.
*H01R 24/00* (2006.01)

(52) U.S. Cl. ..... 439/676

(58) Field of Classification Search ..... 439/281, 439/418, 459, 462, 470, 473, 604, 598, 599
See application file for complete search history.

(56) References Cited

U.S. PATENT DOCUMENTS

| | | | | |
|---|---|---|---|---|
| 3,271,725 | A * | 9/1966 | Bloch | 439/141 |
| 3,588,783 | A * | 6/1971 | Newman | 439/598 |
| 4,335,928 | A | 6/1982 | Barrett et al. | |
| 4,362,348 | A | 12/1982 | Stephenson et al. | |
| 4,494,811 | A | 1/1985 | Palermo, Jr. | |
| 4,737,122 | A * | 4/1988 | Dechelette | 439/418 |
| 4,767,961 | A | 8/1988 | Koller et al. | |
| 4,769,906 | A * | 9/1988 | Purpura et al. | 29/857 |
| 4,799,248 | A | 1/1989 | Furbee et al. | |
| 4,806,113 | A | 2/1989 | Rate et al. | |
| 5,145,402 | A | 9/1992 | Plyler et al. | |
| 5,154,638 | A | 10/1992 | Sireul et al. | |
| 5,162,267 | A | 11/1992 | Smyth | |
| 5,310,361 | A | 5/1994 | Muchowicz et al. | |
| 5,358,419 | A | 10/1994 | Pejsa et al. | |
| 5,384,820 | A | 1/1995 | Burke | |
| 5,553,114 | A | 9/1996 | Siemers et al. | |
| 5,707,252 | A | 1/1998 | Meszaros | |
| 6,140,582 | A | 10/2000 | Sheehan | |
| 6,198,802 | B1 | 3/2001 | Elliot et al. | |
| 6,213,805 | B1 | 4/2001 | Jedlitschka et al. | |
| 6,409,541 | B1 * | 6/2002 | Hattori et al. | 439/587 |
| 6,556,654 | B1 | 4/2003 | Hansen et al. | |
| 6,816,574 | B2 | 11/2004 | Hansen | |
| 2003/0087553 | A1 * | 5/2003 | Tang | 439/610 |

* cited by examiner

*Primary Examiner*—Chandrika Prasad
(74) *Attorney, Agent, or Firm*—Workman Nydegger

(57) ABSTRACT

A high voltage cable assembly is provided that is configured to mate with a corresponding receptacle, and that includes a cable, fitting and terminal element attached to each other so as to define a joint. The cable includes two or more electrical conductors. The terminal element is composed of a resilient, non-electrically conductive material and is connected at one end to the fitting. The other end of the terminal element includes electrical contacts, each of which is in electrical communication with a corresponding electrical conductor of the cable. Additionally, the terminal element defines an annular groove that is situated near the joint cooperatively defined by the fitting and terminal, and aids in the control of diametric expansion of the terminal element, so as to facilitate reduction or elimination of arcing and other problems associated with uncontrolled deformation of the terminal element.

28 Claims, 4 Drawing Sheets

HIGH VOLTAGE CABLE ASSEMBLY WITH ARC PROTECTION

RELATED APPLICATIONS

Not applicable.

BACKGROUND OF THE INVENTION

1. Field of the Invention

The present invention relates generally to x-ray systems, devices, and related components. More particularly, exemplary embodiments of the invention concern a high voltage cable assembly configured to facilitate a reduction in arcing and related problems when the high voltage cable is mated with a corresponding receptacle.

2. Related Technology

The various components employed in x-ray tubes and other high temperature, high-voltage applications are typically required to operate consistently and reliably under extreme conditions for sustained periods of time. In the case of an x-ray device for example, the generation of x-rays, which generally involves accelerating electrons at high speed to a target surface on an anode, can result in operating temperatures as high as 1300° C.

Not only are such components routinely exposed to high operating temperatures, but such components are often subjected to extreme thermal cycles as well. For example, x-ray devices are typically reach a required operating temperature within a time span of just a few minutes. Thus, the rate of change of temperature with respect to time is relatively high. The thermal stresses imposed by such steep temperature gradients often have various destructive or detrimental effects on the structure and performance of the components of the device.

One area where such thermal effects are of particular concern relates to high voltage cables and associated devices and equipment that are employed in connection with high voltage equipment such as x-ray devices. Typical high voltage cables include a cable having one or more electrical conductors electrically isolated from each other and wrapped in a protective covering or sheath. Examples of such cables include the so-called R3, R5, R12 and R24 cables.

Typically, a terminal attached to the end of the cable includes a conical rubber element that terminates, at the narrow end of the cone, in a pair of electrical contacts, each of which is connected with a corresponding electrical conductor of the cable. In general, the conical rubber element is configured and arranged to be received within a correspondingly shaped receptacle so that the contacts on the terminal come into contact with corresponding contacts positioned near the bottom of the receptacle when the conical rubber element is fully received within the receptacle. In many cases, the high voltage cable also includes threads, a flange, or other type of connector to enable the high voltage cable to be removably attached to the receptacle.

Many of such high voltage cable assemblies are configured such that when the cable is operably attached to the receptacle, the joint between the rubber terminal and the cable is located outside of the receptacle. Such arrangements were initially employed in relatively lower temperature applications and proved useful in at least some of those applications. Problems have arisen however where attempts have been made to use such high voltage cable assemblies in applications that were not intended or anticipated.

At least some of the problems experienced in connection with the use of typical cable assemblies in high voltage, high temperature operating environments concern the effects of the associated thermal conditions on the rubber terminal element of the terminal of the cable assembly. In particular, heating of the rubber element causes the portion of the rubber element located outside the receptacle to expand, or spill, over the top of the receptacle so that an annular ring or bulge is formed on top of, and outside, the receptacle. This effect commonly occurs at or near the recommended maximum operating temperature of the cable assembly.

As the cable assembly cools and contracts, the ring contracts partially, but not to the extent that the rubber element reassumes its original configuration. As a result, an annular ring remains fixed in position outside the receptacle. As discussed below, this situation is problematic.

In particular, the position of the annular ring outside the receptacle prevents the terminal of the cable assembly from retracting to the initial, fully seated, position within the receptacle. Consequently, the contacts at the end of the terminal are no longer in physical contact with the corresponding contacts of the receptacle. Thus, when the device is reenergized, the physical separation between the contacts of the terminal and the contacts of the receptacle, in connection with the associated high potential, often causes arcing between the cable assembly and the receptacle, as well as related problems and conditions. Such arcing can damage, or destroy, the cable assembly and/or the device to which the cable assembly is mated.

A related effect is that, because the annular ring, or bulge, remains fixed in position outside the receptacle, the main body of the conical rubber element, located inside the receptacle, tends to pull away from the interior of the receptacle as the cable assembly cools. This separation creates an air gap that causes arcing and related problems when the device is reenergized.

In view of the foregoing, and other, problems in the art, it would be useful to provide a cable assembly configured to reduce, or eliminate, the likelihood of occurrence of arcing and related problems and conditions due to uncontrolled deformation of the terminal element of the terminal.

BRIEF SUMMARY OF AN EXEMPLARY EMBODIMENT OF THE INVENTION

In general, embodiments of the invention are concerned with a cable assembly suitable for use in connection with a variety of high voltage, and other high temperature, applications.

In one exemplary embodiment of the invention, a cable assembly is provided that is configured to mate with a corresponding receptacle, and that includes a cable, a fitting and a terminal. The terminal is attached to the fitting such that a joint is defined. The cable includes electrical conductors wrapped in a protective cover. The terminal includes a terminal element, composed of a resilient, non-electrically conductive material, that is connected at one end to the fitting. The other end of the terminal element includes a pair of electrical contacts, each of which is in electrical communication with a corresponding electrical conductor of the cable. A pair of conductive elements within the terminal element electrically connects the electrical contacts with the electrical conductors of the cable.

In operation, the terminal of the cable assembly is inserted into the receptacle until the contacts of the terminal come into contact with corresponding contacts of the receptacle. Further, the structure of the cable assembly is such that the joint cooperatively defined by the fitting and the terminal resides within the receptacle. In this exemplary implementation, the cable assembly is attached to the receptacle with a flange connection.

As the cable assembly heats up in response to operation of the device with which the cable assembly is employed, diametric expansion of the terminal element is substantially precluded, since the terminal element substantially resides within the receptacle which serves to constrain, if not prevent, such expansion. As a result of this arrangement, little or no permanent deformation is experienced by the terminal element, and the terminal element remains operably positioned within the receptacle.

In this way, exemplary embodiments of the invention provide for, among other things, an effective, reliable, and repeatable, electrical connection that reduces, or eliminates, the likelihood of arcing between the cable assembly and the device with which the receptacle is associated. These and other, aspects of embodiments of the present invention will become more fully apparent from the following description and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF EXEMPLARY EMBODIMENTS OF THE INVENTION

Reference will now be made to the drawings to describe various aspects of exemplary embodiments of the invention. It should be understood that the drawings are diagrammatic and schematic representations of such exemplary embodiments and, accordingly, are not limiting of the scope of the present invention, nor are the drawings necessarily drawn to scale.

Generally, embodiments of the invention concern a cable assembly configured so that the terminal remains fully received within the associated receptacle over a desired range of operating voltages, temperatures and/or other operating conditions. Such exemplary embodiments thus reduce, or eliminate, the likelihood of occurrence of arcing and related problems and conditions due to uncontrolled deformation of the terminal. As a result, exemplary embodiments of the invention enable the implementation of, for example, an effective, reliable, and repeatable electrical connection between the cable assembly and the device with which the receptacle is associated.

Figure 1:
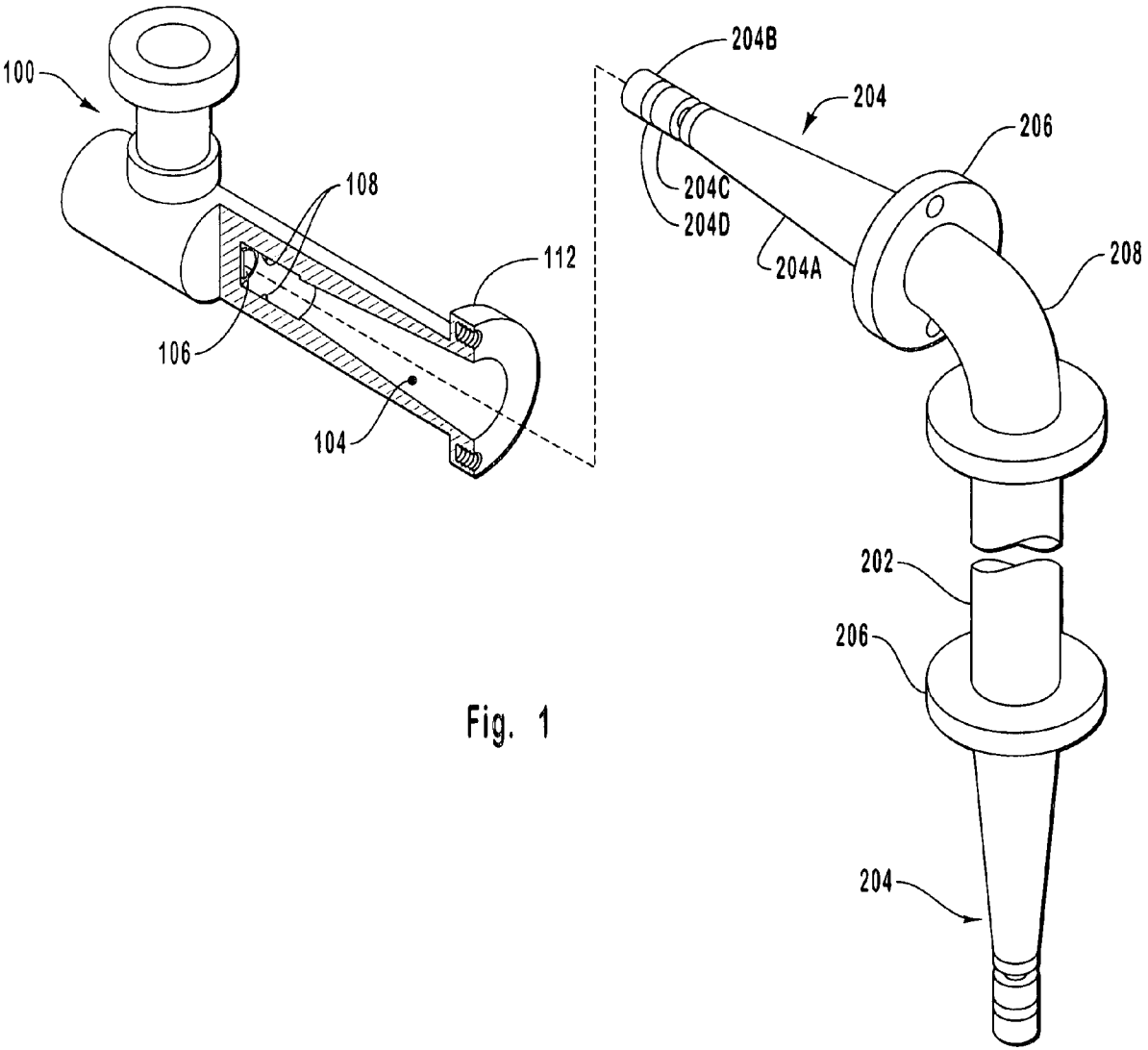
FIG. 1 is an exploded perspective view of an embodiment of a cable assembly and associated exemplary operating environment.

Directing attention now to FIG. 1, details are provided concerning an exemplary operating environment in connection with which exemplary embodiments of the invention may be employed. In particular, a metal-ceramic x-ray device 100 is indicated that is configured to removably mate with a cable assembly 200. The x-ray device 100 includes a body 102 that defines a ceramic high voltage receptacle 104, exemplarily implemented substantially in the shape of a cone. Disposed within the ceramic high voltage receptacle 104 are electrical contacts 106 and 108 configured and arranged for electrical communication with the cable assembly 200, as discussed in further detail below. The x-ray device 100 further includes a window 110 through which x-rays are transmitted. In the illustrated embodiment, a flange 112 is provided as well that is configured and arranged to connect with a mating flange of the cable assembly 200, discussed below.

Note that while embodiments of the cable assembly 200 may be employed in connection with devices such as x-ray tube 100, this exemplary application for cable assembly 200 is not intended to limit the scope of the invention in any way. More generally, cable assembly 200 may be employed in any application or environment where the functionality disclosed herein in connection with cable assembly 200 and its components may prove useful. For example, embodiments of the cable assembly 200 may be employed in connection with devices such as, but not limited to, high tension ("HT") generators, and a variety of other high voltage and high temperature systems and devices.

With continuing reference to FIG. 1, the cable assembly 200 is exemplarily implemented as a two ended assembly that includes a cable 202 having a terminal 204 at either end. In yet other implementations, the cable assembly 200 includes only a single terminal 204 and is hardwired at the other end to a system, device, or component. Various other configurations of the cable assembly 200 may be implemented as well however. By way of example, some cable assemblies 200 include a pair of terminals at one end.

The illustrated embodiment of the cable assembly 200 additionally includes a pair of flanges 206 configured to be bolted to the mating flange of, for example, the x-ray device 100. Various other types of connectors may alternatively be employed however. For example, some embodiments of the cable assembly 200 include twist lock type connectors that can be engaged and disengaged with a short turn, such as a 90 degree rotation. Yet other embodiments of the cable assembly 200 include one or more thread connections, which may be male or female, configured to engage corresponding threads of the system or device to which the cable assembly 200 is to be connected. Various other types of connections may be employed as well.

Further, other exemplary embodiments of the cable assembly 200 additionally, or alternatively, include fittings such as 45 degree and 90 degree elbows. In the illustrated implementation, a fitting, implemented as a 90 degree elbow 208, is provided that is attached to the flange 206. Such fittings may be made of any suitable materials, including various metals.

In addition to the cable 202 and various fittings that are employed in exemplary embodiments of the cable assembly 200, the cable assembly 200 further includes, as noted earlier, one or more terminals 204 that cooperate with the cable 202 to define a joint 210. The terminal 204 may be attached to the cable 202 using any of a variety of suitable processes and devices, such as crimping for example. Note that in some implementations, the terminal 204 is produced as a retrofit item for attachment to cables such as, but not limited to, the R3, R5, R12 and R24 high voltage cables whose older terminals have become deformed or are otherwise unsuited for use.

In the illustrated embodiment, the terminals 204 each include a terminal element 204A that is substantially composed of a resilient, non-electrically conductive material, examples of which include, but are not limited to, rubber, nylon, plastic and silicone. Other materials having similar properties may alternatively be employed.

Figure 2:
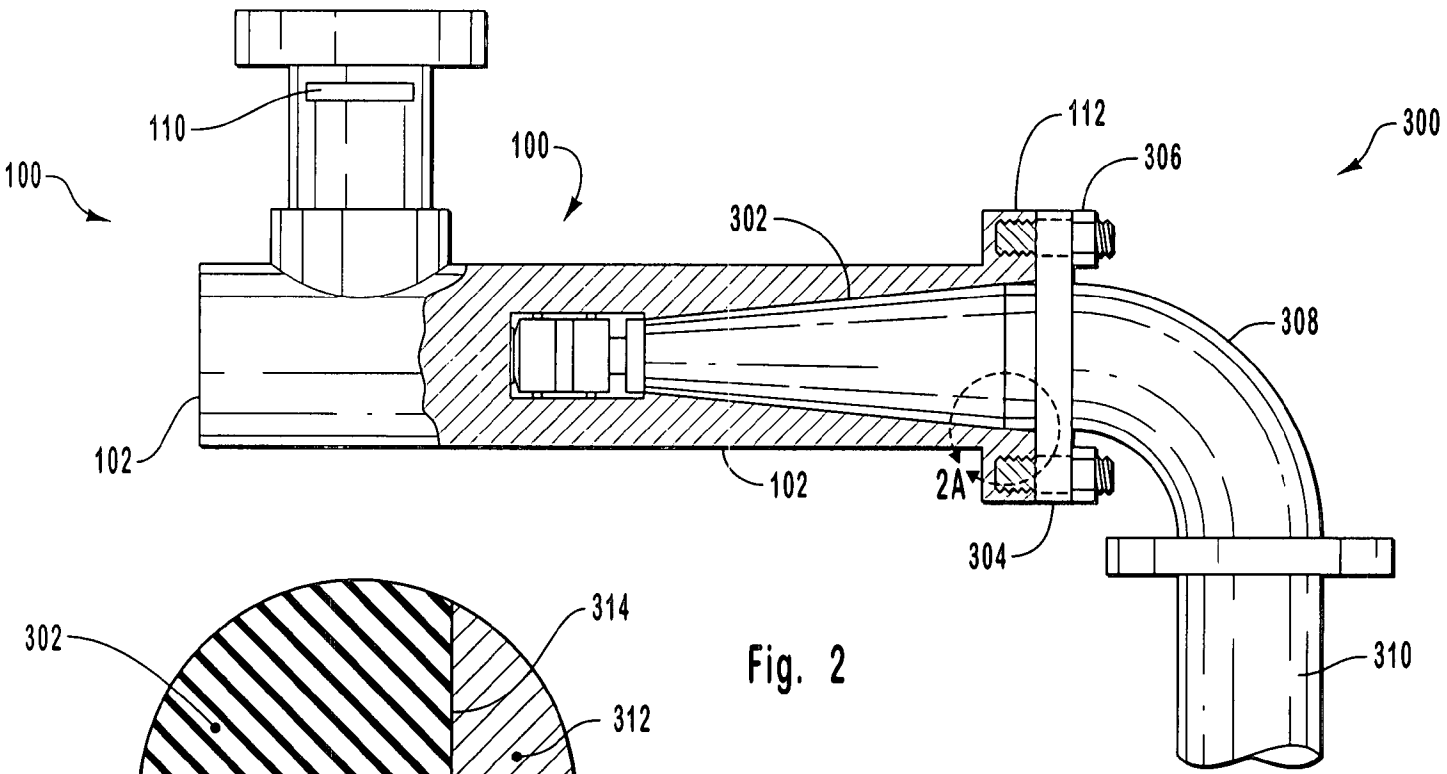
FIG. 2 is a side view of an implementation of a cable assembly and associated exemplary operating environment.

Disposed at one end of the terminal element 204A are a pair of electrical contacts 204B and 204C configured to touch the corresponding contacts 106 and 108, respectively, disposed within the ceramic receptacle 104 when the terminal element 204A is fully received within the ceramic receptacle 104. An insulator 204D electrically isolates the electrical contacts 204B and 204C from each other. The electrical contacts 204B and 204C, in turn, are each connected with a corresponding electrical conductor 205A and 205B respectively (see FIG. 2B) of the cable 202 by way of conductive elements 207A and 207B, respectively (see FIG. 2B) disposed within the terminal element 204A. In this way, electrical communication can be established between the contacts 106 and 108 of the x-ray device 100, and the electrical conductors of the cable assembly 200.

In general then, aspects of exemplary cable assemblies 200 such as, but not limited to, the length, diameter, sheathing type, size and number of conductors, number of electrical contacts, number of connections, connection type, number and type of fittings may be varied as necessary to suit the requirements of a particular application. As the foregoing thus suggests, the scope of the invention is not intended to be, nor should it be construed to be, limited to any particular implementation of cable assembly Directing attention now to FIGS. 2 and 2A, details are provided concerning aspects of an exemplary cable assembly 300 as employed in connection with a device such as x-ray device 100. As the exemplary cable assembly 200 illustrated in FIG. 1 is similar in many regards to the exemplary cable assembly 300, only certain aspects of the cable assembly 300 will be considered in detail in connection with the discussion of FIGS. 2 and 2A.

In general, the cable assembly 300 includes a terminal element 302 having contacts 302A and 302B configured and arranged for electrical communication with the corresponding contacts 106 and 108, respectively, of the x-ray device 100. The terminal element 302 is generally sized and configured to occupy a substantial portion of the receptacle 104 so that, in some exemplary implementations at least, the terminal element 302 is in substantial contact with the walls of the receptacle 104. The cable assembly 300 is removably retained in this position by way of a flange 304 that is bolted to the mating flange 112 of the x-ray device 100 by way of bolts 306. The flange 304, in turn, is attached to a fitting, 90 degree elbow 308 in this example, wherein the cable 310 of the cable assembly 300 is received.

Figure 2A:
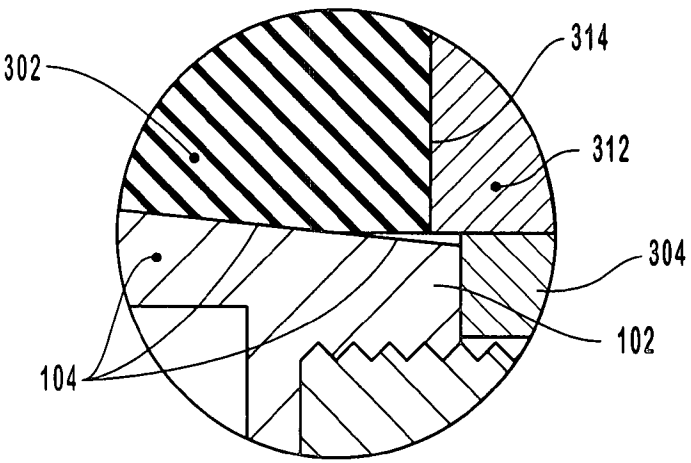
FIG. 2A is a detail view taken from FIG. 2 and showing aspects of the arrangement of the cable assembly relative to the exemplary operating environment.
Figure 2B:
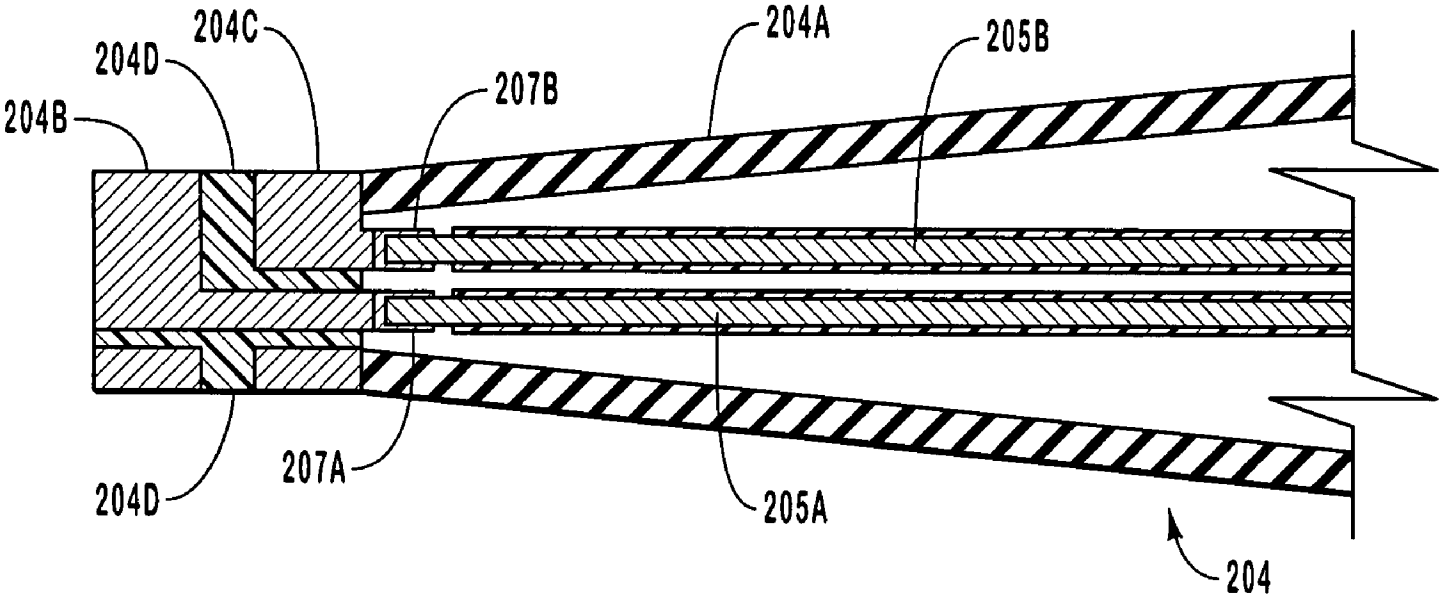
FIG. 2B is a detail view providing further information concerning the exemplary devices disclosed in FIGS. 1 and 2, particularly with respect to an example arrangement of electrical contacts, conductive elements, and electrical conductors within a terminal.

As best illustrated in FIG. 2A, an interface portion 312 of the 90 degree elbow fitting 308 extends from the flange 304 and is attached to the terminal element 302 so that a joint 314 is cooperatively defined by the fitting 308, specifically, the interface portion 312, and the terminal element 302. In this particular implementation, the interface portion 312 and terminal element 302 are configured and arranged so that when the cable assembly 300 is operably mated with the receptacle 104, the joint 314 cooperatively defined by the fitting and the terminal element 302 resides within, or below the top of, the receptacle 104. The specific position and location of the joint 314 within the receptacle 104 may be varied as necessary to suit the requirements of a particular application.

This arrangement has various useful implications. For example, location of the joint 314 at a desired depth within the receptacle 104 ensures that any thermally induced diametric expansion of the terminal element 302, will be minimal, or nonexistent, due to the location of the joint 314 within the receptacle 104, and due to the relatively close fit between the receptacle 104 and the terminal element 302. Because no significant diametric expansion or deformation of the terminal element 302 can occur, the location of the joint 314 within the receptacle enables the terminal element 302 to remain operably seated within the receptacle 104 over a wide range of operating temperatures.

Further, because the ring or bulge deformation associated with many known cable assemblies has not formed, and cannot form, the cooling of the cable assembly 300 has no detrimental effect on the positioning of the terminal element 302 within the receptacle 104. Thus, arcing between the cable assembly 200 and the receptacle 104, is substantially precluded.

Figure 3:
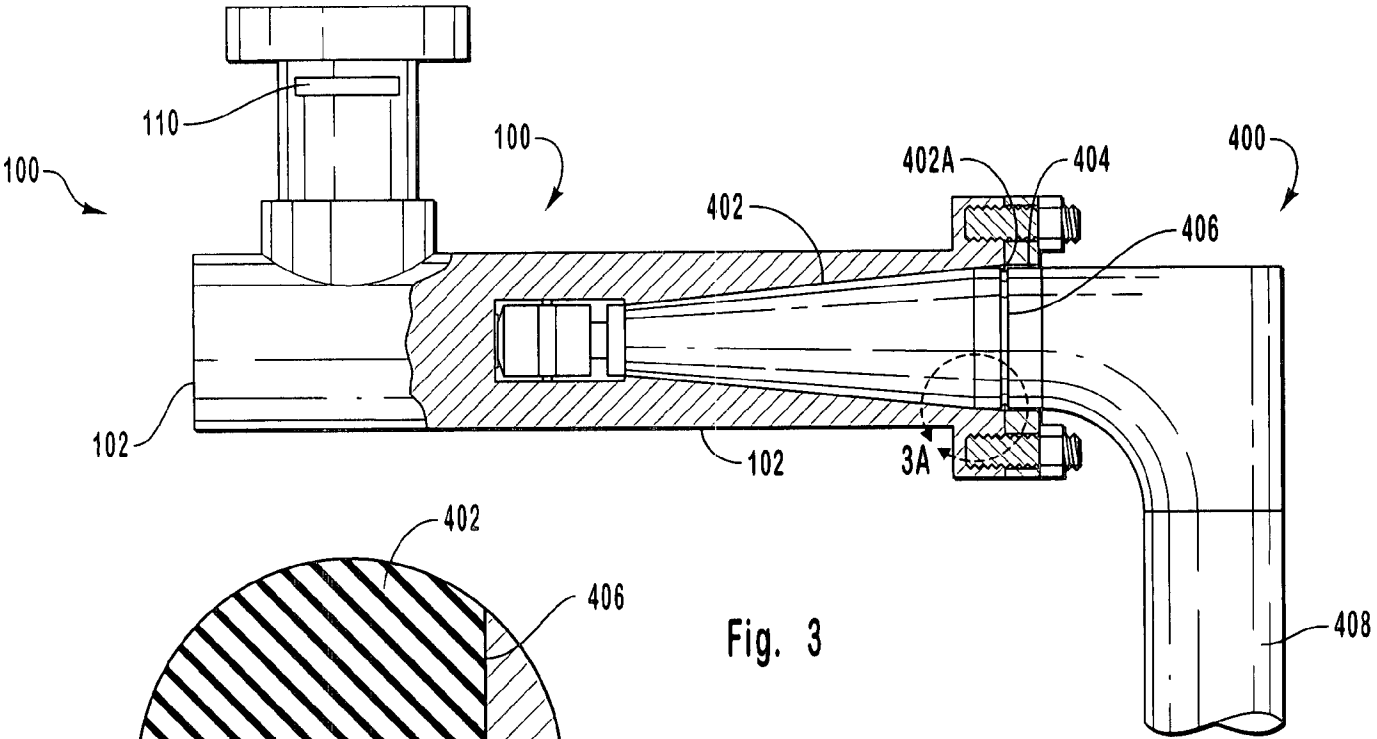
FIG. 3 is a side view of an alternative implementation of a cable assembly.
Figure 3A:
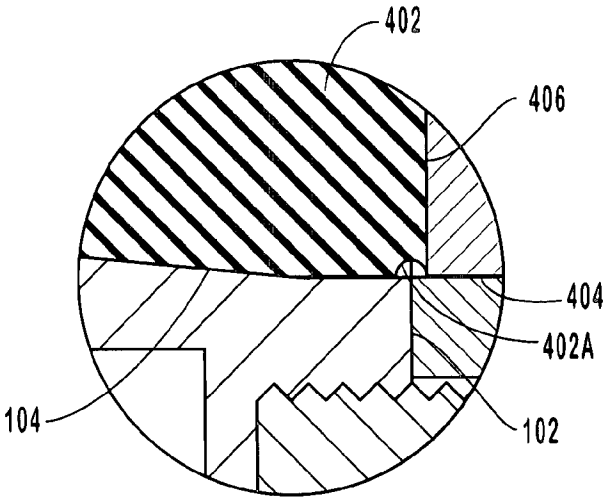
FIG. 3A is a detail view of a portion of the cable assembly of FIG. 3, showing aspects of the arrangement of the cable assembly as they relate to an exemplary operating environment.

With attention now to FIGS. 3 and 3A, details are provided concerning aspects of an exemplary cable assembly 400. Similar to the exemplary cable assemblies 200 and 300, the cable assembly 400 includes a terminal element 402 having contacts (not shown) configured and arranged for electrical communication with the corresponding contacts (not shown) of an operating environment such as an x-ray device. Further, the terminal element 402 is attached to a fitting 404 of the cable assembly 400 so that a joint 406 is cooperatively defined by the terminal element 402 and the fitting 404. The exemplary cable assembly 400 additionally includes a cable 408 that is attached to the fitting 404.

It should be noted that while, in the illustrated embodiment, the fitting 404 is metal and takes the form of a 90 degree elbow that includes a pair of flanges, the scope of the invention is not limited to any particular type, material or configuration of fittings 208, 308 or 404. For example, one or more of such fittings may comprise any fitting that defines a bend. Moreover, the fitting need not define a bend in every case. Rather, in some other implementations, the fitting is a substantially straight section. In yet other cases, the fitting may comprise one or more bent sections and straight sections in combination. Further, the fittings need not include flanges. Rather, any other devices, structures and/or techniques for joining the fitting to the terminal element may be employed.

In this exemplary embodiment, the terminal element 402 defines a groove 402A that extends around a substantial portion of the circumference of the terminal element 402, so that the groove is substantially annular, and is located proximate the joint 406. Additional or alternative locations for the groove 402A may be selected as well however. Further, aspects of the geometry and location of the groove 402A may be varied as necessary to suit the requirements of a particular application.

By way of example, alternative implementations of the groove 402A have a substantially rectangular, or triangular, cross-section. Implementations of the groove 402A having a partial elliptical, or partial circular cross-sectional shape may be employed as well. Further, the depth and width of the groove 402A may be varied as necessary. As well, the groove may be defined by cutting, forming, molding, machining or any other suitable process. Finally, some implementations of the invention include multiple grooves, each of whose geometry may be selected to suit a particular purpose or application. Consistent with the foregoing, the scope of the invention should not be construed to be limited to any particular groove implementation.

In the illustrated embodiment, the groove 402A is defined by the terminal element 402 such that when the terminal element 402 is operably received within the receptacle 104, the groove 402A is located proximate the opening of the receptacle 104, as best illustrated in FIG. 3A. Thus, even though the joint 406 is located outside, or above, the receptacle 104, the formation of the groove 402A results in the effective removal of the terminal element 402 material that, if otherwise present, would expand above the receptacle 104 and deform in the manner associated with many known cable assemblies. Additionally, the presence of the groove 402A enables the terminal element 402 to remain operably seated within the receptacle 104 over a wide range of operating temperatures. In this way, the deformation of the terminal element 402, and the associated problems resulting from such deformation, are substantially precluded.

As indicated by the disclosure herein, a variety of means may be employed to perform the functions disclosed herein, concerning control of the diametric expansion of the terminal element of the cable assembly. Thus, the configuration of the terminal element/fitting joint such that the joint is able to reside within the receptacle, as well as the groove defined in some embodiments of the terminal element, comprise but two exemplary structural implementations of a means for facilitating control of the diametric expansion of the terminal element.

Accordingly, it should be understood that such structural implementations are disclosed herein solely by way of example and should not be construed as limiting the scope of the present invention in any way. Rather, any other structure or combination of structures effective in implementing the functionality disclosed herein may likewise be employed. By way of example, in some embodiments of the cable assembly, a groove is formed in the terminal element and, further, the joint between the terminal element and the cable resides within the receptacle.

The described embodiments are to be considered in all respects only as exemplary and not restrictive. The scope of the invention is, therefore, indicated by the appended claims rather than by the foregoing description. All changes which come within the meaning and range of equivalency of the claims are to be embraced within their scope.

What is claimed is:

1. An electrical cable assembly configured to mate with a receptacle that is at least partially defined by a body of an x-ray device, the electrical cable assembly comprising:

a cable having a plurality of conductors;

a fitting to which the cable is attached; and a terminal attached to the fitting such that when the electrical cable assembly is mated with the receptacle that is at least partially defined by the x-ray device body, a joint cooperatively defined by the terminal and the fitting is substantially disposed within the receptacle, the terminal comprising:

a terminal element substantially comprising a resilient non-electrically conductive material and having first and second ends, the first end being attached to the fitting; and a plurality of electrical contacts at least indirectly attached to the terminal element proximate the second end, each of the plurality of electrical contacts being in electrical communication with a corresponding conductor of the cable.

2. The electrical cable assembly as recited in claim 1, wherein the terminal element is substantially in the shape of a cone.

3. The electrical cable assembly as recited in claim 1, wherein the resilient non-electrically conductive material of the terminal element substantially comprises a material selected from the group consisting of: rubber; nylon; silicon; and, polytetrafluoroethylene.

4. The electrical cable assembly as recited in claim 1, further comprising a connector configured and arranged to enable removable attachment of the electrical cable assembly to the receptacle.

5. The electrical cable assembly as recited in claim 1, further comprising an additional terminal attached to the cable.

6. An electrical cable assembly, comprising:

a cable having a plurality of electrical conductors;

a filling to which the cable is attached; and a terminal attached to the filling and configured to be received within a receptacle at least partially defined by a body of an x-ray device, the terminal comprising:

a terminal element substantially comprising a resilient, non-electrically conductive material and having first and second ends, the first end being joined to the filling so that a joint is cooperatively defined by the terminal and the filling, and the terminal element defining a substantially annular groove located proximate the joint; and a plurality of electrical contacts at least indirectly attached to the terminal element proximate the second end, each of the plurality of electrical contacts being in electrical communication with a corresponding electrical conductor of the cable.

7. The electrical cable assembly as recited in claim 6, wherein a cross-sectional shape of the substantially annular groove comprises a portion of a circle.

8. The electrical cable assembly as recited in claim 6, wherein the terminal element is substantially in the shape of a cone.

9. The electrical cable assembly as recited in claim 6, wherein the resilient non-electrically conductive material of the terminal element substantially comprises a material selected from the group consisting of rubber; nylon; silicon; and, polytetrafluoroethylene.

10. The electrical cable assembly as recited in claim 6, further comprising a connector configured and arranged to enable removable attachment of the electrical cable assembly to the receptacle.

11. The electrical cable assembly as recited in claim 6, further comprising an additional terminal attached to the cable.

12. An electrical cable assembly configured to mate with a receptacle, the receptacle included with a body of an x-ray device, the electrical cable assembly comprising:

a cable having a plurality of electrical conductors;

a metal fitting to which the cable is attached; and a terminal attached to the cable, the terminal comprising:

a terminal element substantially comprising a resilient non-electrically conductive material and having first and second ends, the first end being joined to the metal fitting;

a plurality of electrical contacts at least indirectly attached to the terminal element proximate the second end, each of the plurality of electrical contacts being in electrical communication with a corresponding electrical conductor of the cable; and means for facilitating control of the diametric expansion of the terminal element disposed within the receptacle that is included with the x-ray device body.

13. The electrical cable assembly as recited in claim 12, wherein the means for facilitating control of the diametric expansion of the terminal element substantially prevents the terminal element from expanding beyond the confines of the receptacle when the electrical cable assembly is mated with the receptacle.

14. The electrical cable assembly as recited in claim 12, wherein the means for facilitating control of the diametric expansion of the terminal element substantially precludes arcing between the electrical cable assembly and the receptacle.

15. The electrical cable assembly as recited in claim 12, wherein the means for facilitating control of the diametric expansion of the terminal element contributes to retention of the terminal element in an operational position relative to the receptacle while the electrical cable assembly is mated with the receptacle.

16. The electrical cable assembly as recited in claim 12, wherein the means for facilitating control of the diametric expansion of the terminal element comprises a joint formed at the connection of the terminal element and the metal fitting and configured and arranged to reside substantially within the receptacle when the electrical cable assembly is mated with the receptacle.

17. The electrical cable assembly as recited in claim 12, wherein the terminal element is substantially in the shape of a cone.

18. The electrical cable assembly as recited in claim 12, wherein the resilient non-electrically conductive material of the terminal element substantially comprises a material selected from the group consisting of: rubber; nylon; silicon; and, polytetrafluoroethylene.

19. The electrical cable assembly as recited in claim 12, further comprising a connector configured and arranged to enable removable attachment of the electrical cable assembly to the receptacle.

20. The electrical cable assembly as recited in claim 12, further comprising an additional terminal attached to the cable.

21. The electrical cable assembly as recited in claim 12, wherein the metal fitting comprises an elbow configuration.

22. A high voltage electrical cable assembly configured to mate with a receptacle, the receptacle included with a body of an x-ray device, the high voltage electrical cable assembly comprising:

a cable having a plurality of electrical conductors;

a filling to which the cable is attached; and a terminal attached to the filling, the terminal comprising;

a terminal element substantially comprising a resilient non-electrically conductive material and being substantially conical in shape, the terminal element having first and second ends, the first end being attached to the filling;

a plurality of conductive elements substantially disposed within the terminal element, each of the conductive elements being in electrical communication with a corresponding electrical conductor of the cable; and a plurality of electrical contacts at least indirectly attached to the terminal element proximate the second end, each of the plurality of electrical contacts being in electrical communication with a corresponding conductive element of the terminal element;

means for facilitating control of the diametric expansion of the terminal element; and a connector configured to enable removable attachment of the high voltage electrical cable assembly to the receptacle that is included with the x-ray device body.

23. The high voltage electrical cable assembly as recited in claim 22, wherein the means for facilitating control of the diametric expansion of the terminal element substantially prevents the terminal element from expanding beyond the confines of the receptacle when the electrical cable assembly is mated with the receptacle.

24. The high voltage electrical cable assembly as recited in claim 22, wherein the means for facilitating control of the diametric expansion of the terminal element substantially precludes arcing between the electrical cable assembly and the receptacle.

25. The high voltage electrical cable assembly as recited in claim 22, wherein the means for facilitating control of the diametric expansion of the terminal element contributes to retention of the terminal element in an operational position relative to the receptacle while the electrical cable assembly is mated with the receptacle.

26. The high voltage electrical cable assembly as recited in claim 22, wherein the means for facilitating control of the diametric expansion of the terminal element comprises a joint formed at the connection of the terminal element and fitting and being configured and arranged to reside substantially within the receptacle when the electrical cable assembly is mated with the receptacle.

27. The high voltage electrical cable assembly as recited in claim 22, further comprising a connector configured and arranged to enable removable attachment of the electrical cable assembly to the receptacle.

28. The high voltage electrical cable assembly as recited in claim 22, further comprising an additional terminal attached to the cable.

* * * * *

UNITED STATES PATENT AND TRADEMARK OFFICE

CERTIFICATE OF CORRECTION

PATENT NO. : 7,445,517 B2
APPLICATION NO. : 10/826774
DATED : November 4, 2008
INVENTOR(S) : Hansen et al.

It is certified that error appears in the above-identified patent and that said Letters Patent is hereby corrected as shown below:

Drawings

Sheet 1, replace FIG. 1 with the figure depicted herein below, wherein the cable assembly 200 has been labeled

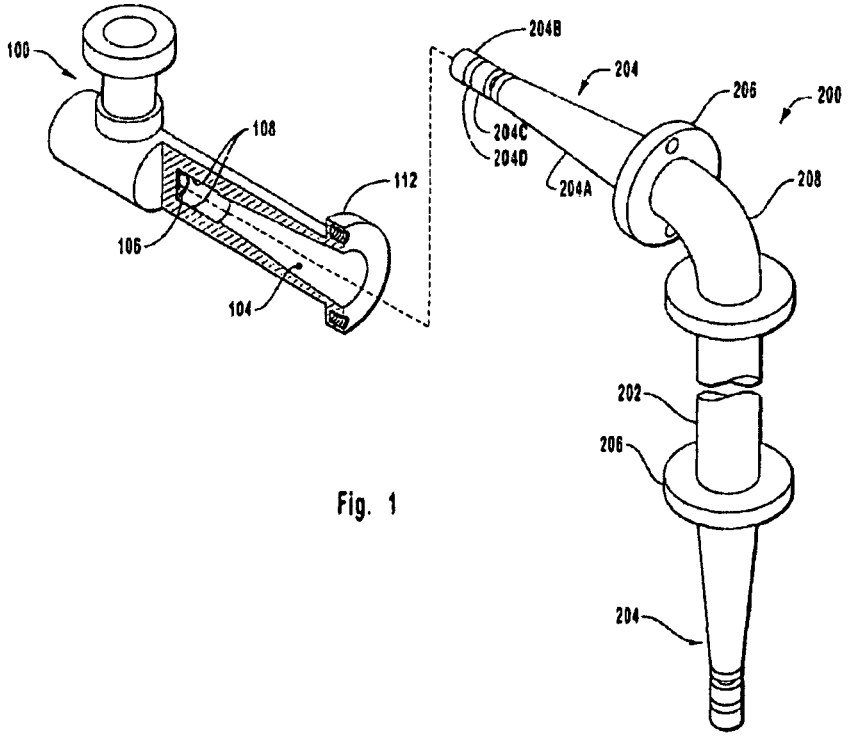

Fig. 1

Signed and Sealed this

Twenty-fourth Day of August, 2010

David J. Kappos

David J. Kappos
*Director of the United States Patent and Trademark Office*

Drawings
Sheet 2, replace FIGS. 2 and 2A with the figure depicted herein below, wherein the contacts 302A and 302B have been labeled

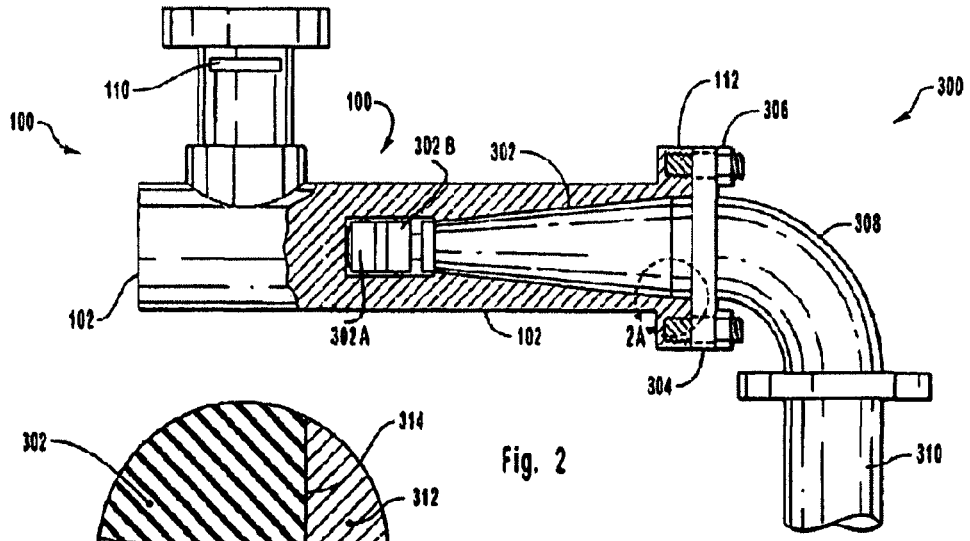

Fig. 2

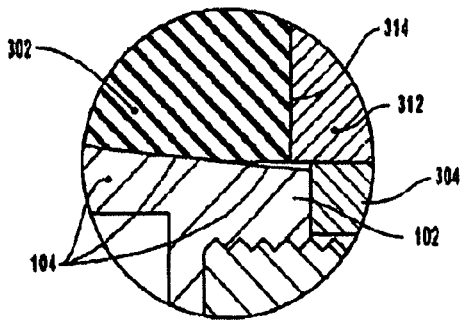

Fig. 2A

Column 1
Line 29, change "devices are typically" to --devices typically--

Column 4
Line 15, change "102" to --102 (see FIG. 2)--
Line 21, change "110" to --110 (see FIG. 2)--

Column 5
Line 2, remove "210"
Line 50, change "106 and 108" to --106 and 108 (see FIG 1.)--

Column 6
Line 24, change "200" to --300--

Column 8
Lines 21, 22, 28, and 29, change "filling" to --fitting--

Column 9
Line 52 and 53, change "filling" to --fitting--

Column 10
Line 5, change "filling" to --fitting--